US007007601B2

(12) United States Patent
Winter et al.

(10) Patent No.: US 7,007,601 B2
(45) Date of Patent: Mar. 7, 2006

(54) HIGH SPEED MOUNTING AND PRINTING FOR COLORED CHIPS ON A SHEET

(75) Inventors: Steven B. Winter, Highland Park, IL (US); Stanley I. Lerner, Glencoe, IL (US)

(73) Assignee: Color Communications, Inc., Chicago, IL (US)

( * ) Notice: Subject to any disclaimer, the term of this patent is extended or adjusted under 35 U.S.C. 154(b) by 10 days.

(21) Appl. No.: 10/852,778

(22) Filed: May 25, 2004

(65) Prior Publication Data

US 2004/0237811 A1 Dec. 2, 2004

Related U.S. Application Data

(60) Provisional application No. 60/474,172, filed on May 29, 2003.

(51) Int. Cl.
*G09F 5/04* (2006.01)

(52) U.S. Cl. ..... 101/35; 101/153; 156/561

(58) Field of Classification Search ..... 156/561
See application file for complete search history.

(56) References Cited

U.S. PATENT DOCUMENTS

| | | | | |
|---|---|---|---|---|
| 1,644,044 A | * | 10/1927 | Urie | 156/561 |
| 1,943,390 A | * | 1/1934 | Oser | 156/561 |
| 2,525,612 A | * | 10/1950 | McKay et al. | 156/561 |
| 4,061,521 A | | 12/1977 | Lerner et al. | |
| 4,379,696 A | | 4/1983 | Lerner | |
| 4,457,718 A | | 7/1984 | Lerner | |
| 5,313,884 A | | 5/1994 | Lerner et al. | |
| 5,370,024 A | | 12/1994 | Lerner et al. | |
| 5,622,594 A | | 4/1997 | Lerner et al. | |
| 6,030,481 A | | 2/2000 | Winter et al. | |
| 6,086,694 A | | 7/2000 | Winter et al. | |

FOREIGN PATENT DOCUMENTS

| | | | |
|---|---|---|---|
| JP | 2004045720 A | * | 2/2004 |
| JP | 2004198857 A | * | 7/2004 |

* cited by examiner

*Primary Examiner*—Daniel J. Colilla
(74) *Attorney, Agent, or Firm*—Fitch, Even, Tabin & Flannery

(57) ABSTRACT

A method and apparatus use an in-line printer to print on chips or swatches mounted on an underlying substrate such as a sheet or web of paper or paperboard. The chips may have varying heights due to variations of thickness of the paint on the chip and/or adhesive mounting the chips to the substrate. The sheets are continuously moving through the chip mounting machine and the printing machine which are synchronized to operate at the same speed. In the illustrated apparatus, conveyor pushers push the sheets through the chip mounting machine and through the printer machine and resilient strips on the printing roller form a nip with an underlying anvil roller to grip and hold the chips against shifting to prevent smearing of the ink as the sheets are pushed through the nip between the printing cylinder and the anvil roller. An in-line trimming apparatus such as die cutter may cut the chips to size and/or shape as to provide rectangularly mounted chips with arcs, curves, circles, etc. The trimmed scrap from a trimmed chip is removed by a vacuum conveying system. In the illustrated apparatus, an in-line folder may fold the printed chip bearing sheets to complete the illustrated in-line apparatus and method.

31 Claims, 12 Drawing Sheets

HIGH SPEED MOUNTING AND PRINTING FOR COLORED CHIPS ON A SHEET

This application claims benefit of provisional application 60/474,172, filed on May 29, 2003.

BACKGROUND OF THE INVENTION

This invention relates to a method of and an apparatus for mounting and printing on swatches or colored chips on sheets.

In U.S. Pat. Nos. 4,061,521; 6,030,481; and 6,086,694 there are disclosed methods and apparatus for manufacture of a colored chip or colored swatch bearing sheet, e.g., a color chart comprising a base sheet on which are mounted several adhesively attached colored chips with the color of each chip having been made by a particular colored paint.

As disclosed in U.S. Pat. No. 4,061,521, sheets are moved intermittently through a machine to receive a number of colored chips thereon with the sheets being stopped at adhesive station where a rotating adhesive cylinder applies adhesive at the chip receiving locations. At a swatch applying station various colored chips are severed from colored ribbons and are applied by a swatch applying cylinder to the respective adhesive spots to adhere the chips to the sheet. Often the chips are adhered close to printing on the sheet or in a preprinted box on the sheet and the chips are placed very precisely on the sheet particularly with respect to the printing. The sheets may vary from relatively thin paper that is about 0.0035 to 0.0040 inch thick as well as to paper board that is about 0.008 to 0.010 inch thick. Often the swatches vary in area, thickness of the swatch material and the pattern of their deposition on a sheet.

A U.S. Pat. No. 6,086,694 discloses a method and apparatus for the manufacture of chip bearing sheets with the swatches being adhered to a web which is usually preprinted and which is cut into sheets after all the swatches have been applied to the web for a given sheet length.

Heretofore, it has been desired to print on the colored chips adhered to the sheet by whatever process, such as the sheet process disclosed in U.S. Pat. No. 4,061,521 or in a web machine patent disclosed in U.S. Pat. No. 6,086,694. If the colored chips were to have any printing thereon, the sheets bearing the chips were taken to a remote off-line printing machine and printing was done on the chips at the remote location.

The sheets leaving one of the machines described above were usually in the form of either rectangular or square shapes and if it was desired to change the shape of one or more of the chips, the sheets would taken to an off-line die cutting system which would remove the excess scrap material about the desired shape. That is the die cutting system had dies to cut the chips to provide curves, circles, arcs, etc. on the chip with the excess material cut from the rectangular portion of the sheet being scrap and removed.

SUMMARY OF THE INVENTION

There is provided a new and improved method and apparatus for the manufacture of chip bearing sheets having chips thereon with printing on the chips. This is achieved by placing a printing station in line with the chip mounting station for performing a printing operation, to print indicia on the outer surface of the colored chips.

In the illustrated embodiment, the chips are oversized and at least some of the oversized chips are trimmed at a on-line trimming station which trims the chips to size. The trimmed material, which is scrap, then is removed by a vacuum system which extracts the scrap. The embodiment illustrated hereinafter there is also provided an in-line folder which automatically folds the sheets.

In the embodiment illustrated and described hereinafter, the chips are applied and adhered to discrete sheets which are pushed forwardly through the chip applying station and into a printing station where the chips are also pushed by pushers engaging the trailing end of the sheet through the printing station where a printer prints indicia on the outer surface of the colored chips. To avoid smearing of the printing ink being deposited on a chip, there is provided a nip between the printing cylinder and an anvil cylinder with the nip holding the sheets and the chips positively during printing. The chips are spaced axially with respect to the axis of the printing cylinder which has strips of elastomeric material between raised printing surfaces to form a nip with an underlying anvil roller to hold the sheet at locations closed adjacent the raised printing surfaces to prevent the smudging or smearing of the ink being printed on the chips.

Also, in accordance with the illustrated embodiment described hereinafter, it is preferred to print on the chips with UV ink at multiple stations with a UV curing device for applying UV energy to the ink to cure the same following the printing operation.

In the illustrated embodiment described hereinafter, the chips are sized and often some of the chips are formed with a curved circle or arc or the like at a die cutting station wherein an outer portion of the chip that is not adhered to the underlying sheet or web is severed and is removed by a vacuum after having been severed.

In the embodiment illustrated and described hereinafter the scrap outer portion of the chip being cut at the die station is adhered to the die cutting cylinder for a short distance as it rotates away from the nip and then another vacuum extracts the scrap from the printing cylinder preferably with a release of the vacuum within the die cutting cylinder. Preferably a positive blast of air is applied to push the scrap from the cylinder and into the extracting pipe which has a vacuum to convey the scrap away from the cylinder.

In accordance with the embodiment illustrated and described herein, a method and apparatus are provided mounting color chip swatches on a sheet, feeding the sheet forwardly into a printing station, printing on the chips while they are traveling in line, and trimming the chips to size by an in-line trimmer at a trimming station. The swatches and sheets are aligned for travel in a longitudinal direction and are aligned in a transverse direction and are traveling at synchronized speeds of travel through the respective swatch applying station, the printing station and the trimming station. In the preferred embodiment, an in-line folding station is also aligned with the other machine at the other stations with its speed of folding synchronized in order to receive the sheets with printed and trimmed swatches and to automatically fold these sheets to provide folded sheets with printed and trimmed swatches thereon. In accordance with another aspect, an air stream such as a vacuum conveying system automatically removes scrap cut from the trimmed swatches and/or trimmed sheets.

DETAILED DESCRIPTION OF THE PREFERRED EMBODIMENT

Figure 1:
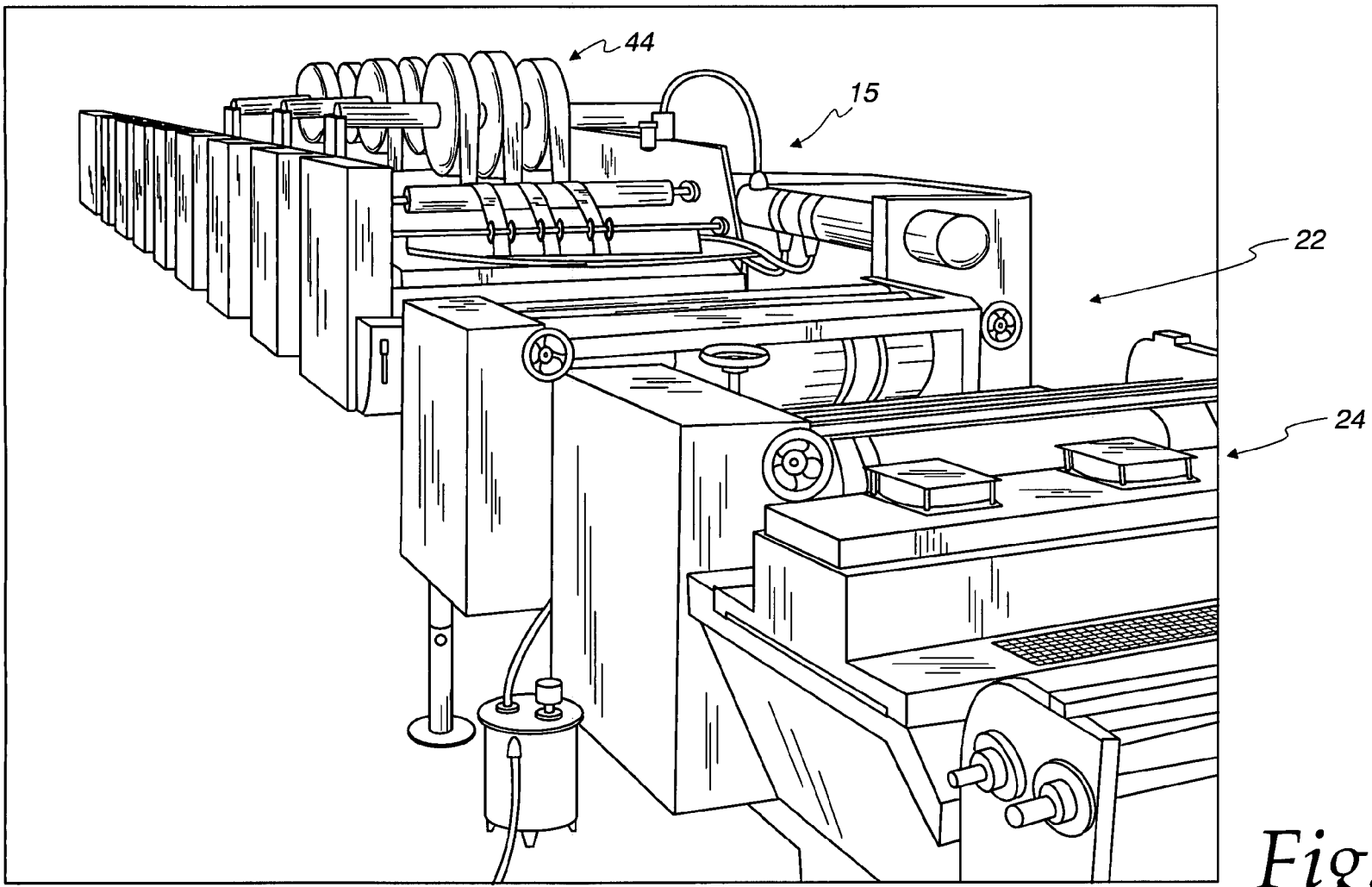
FIG. 1 is a perspective view of an in-line apparatus constructed in accordance with one embodiment having a swatch forming and applying apparatus in-line with a printing station and folder station.
Figure 4:
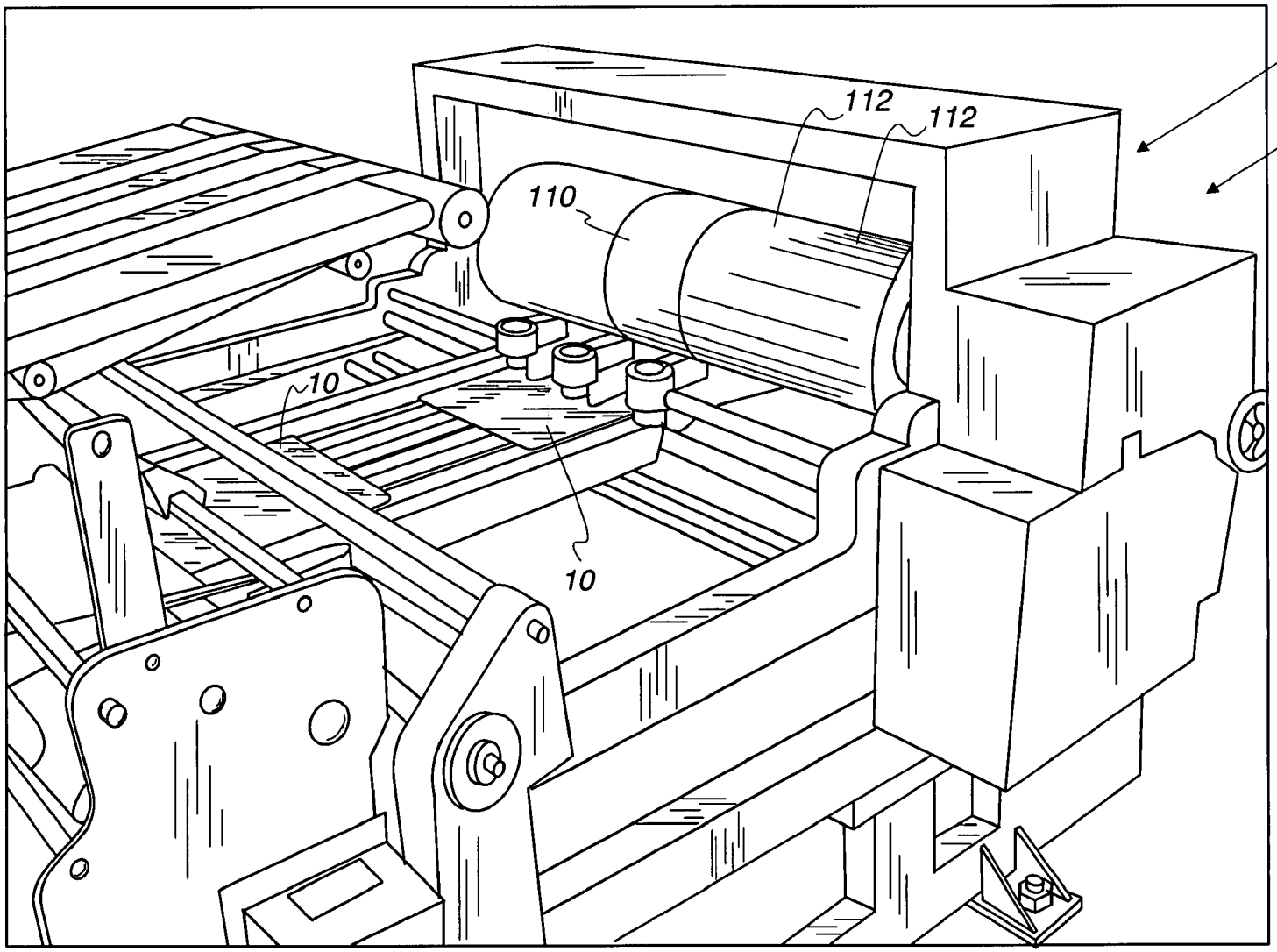
FIG. 4 is a perspective view of a die cutting station having flexible dies for cutting the chips on the sheet.
Figure 5:
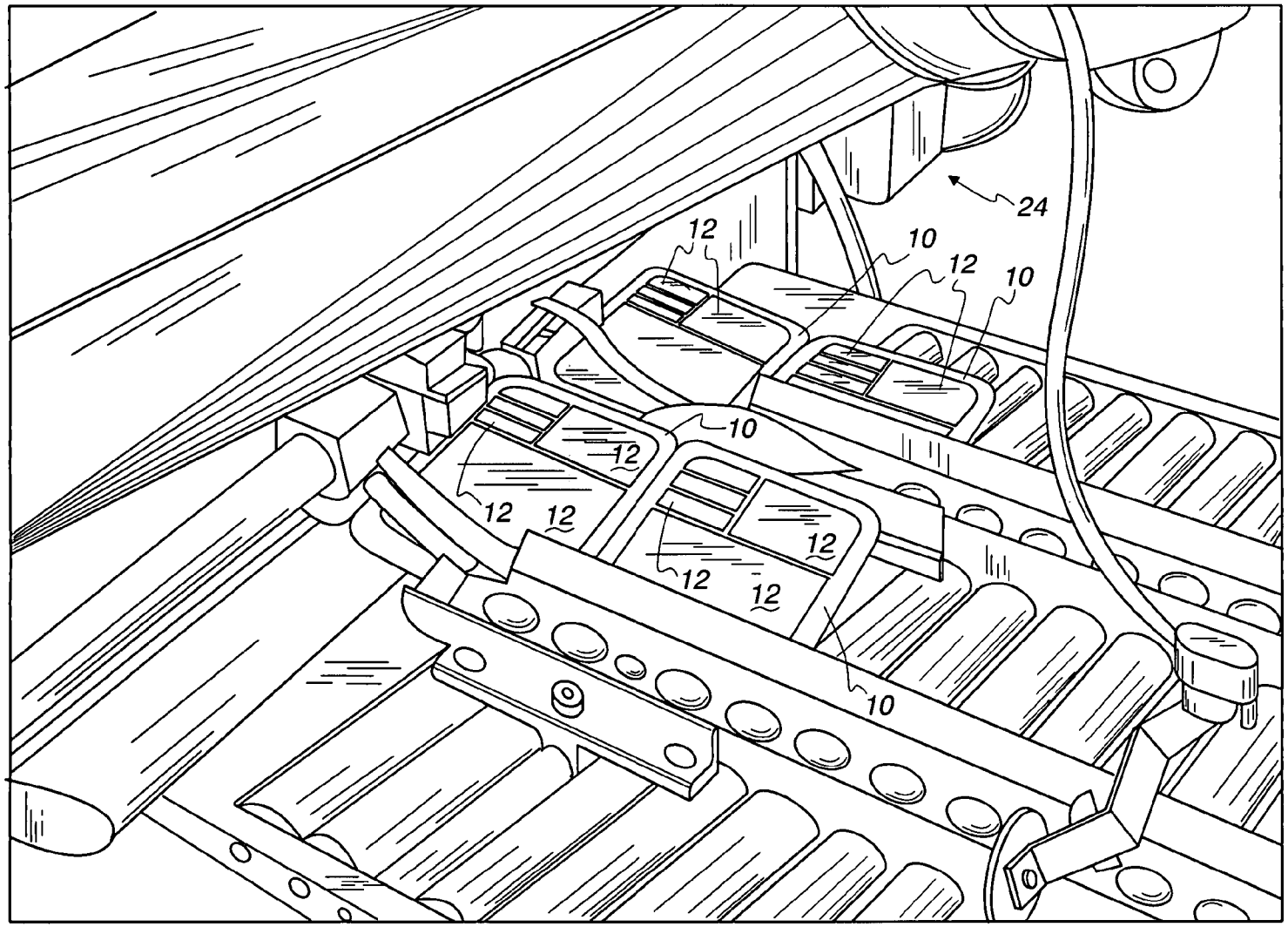
FIG. 5 illustrates a sheet leaving the die cutting station after the card has been trimmed and cut to any size and is ready to be folded.
Figure 6:
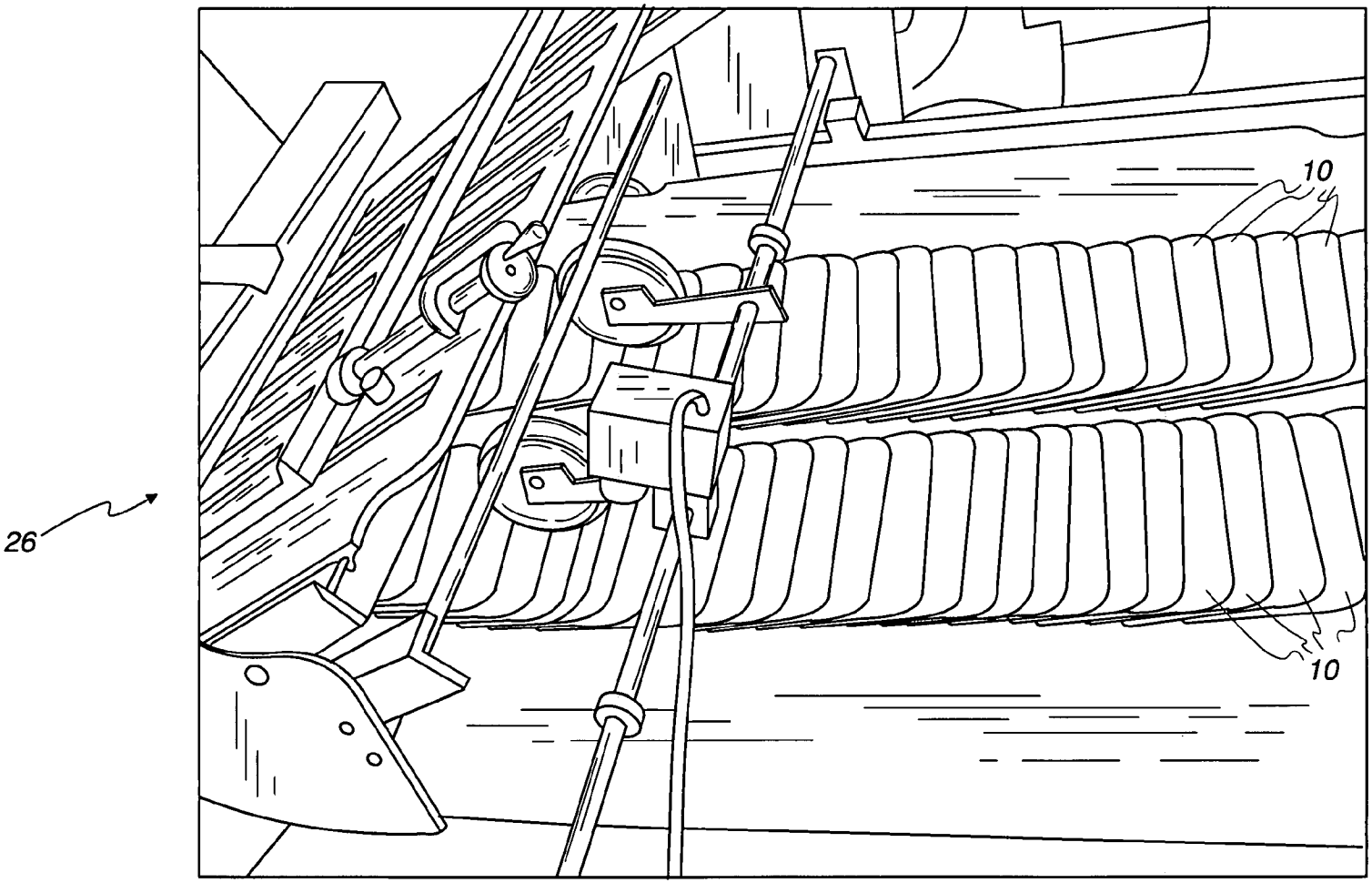
FIG. 6 illustrates a card or sheet leaving the folder and ready to be boxed and shipped.
Figure 7:
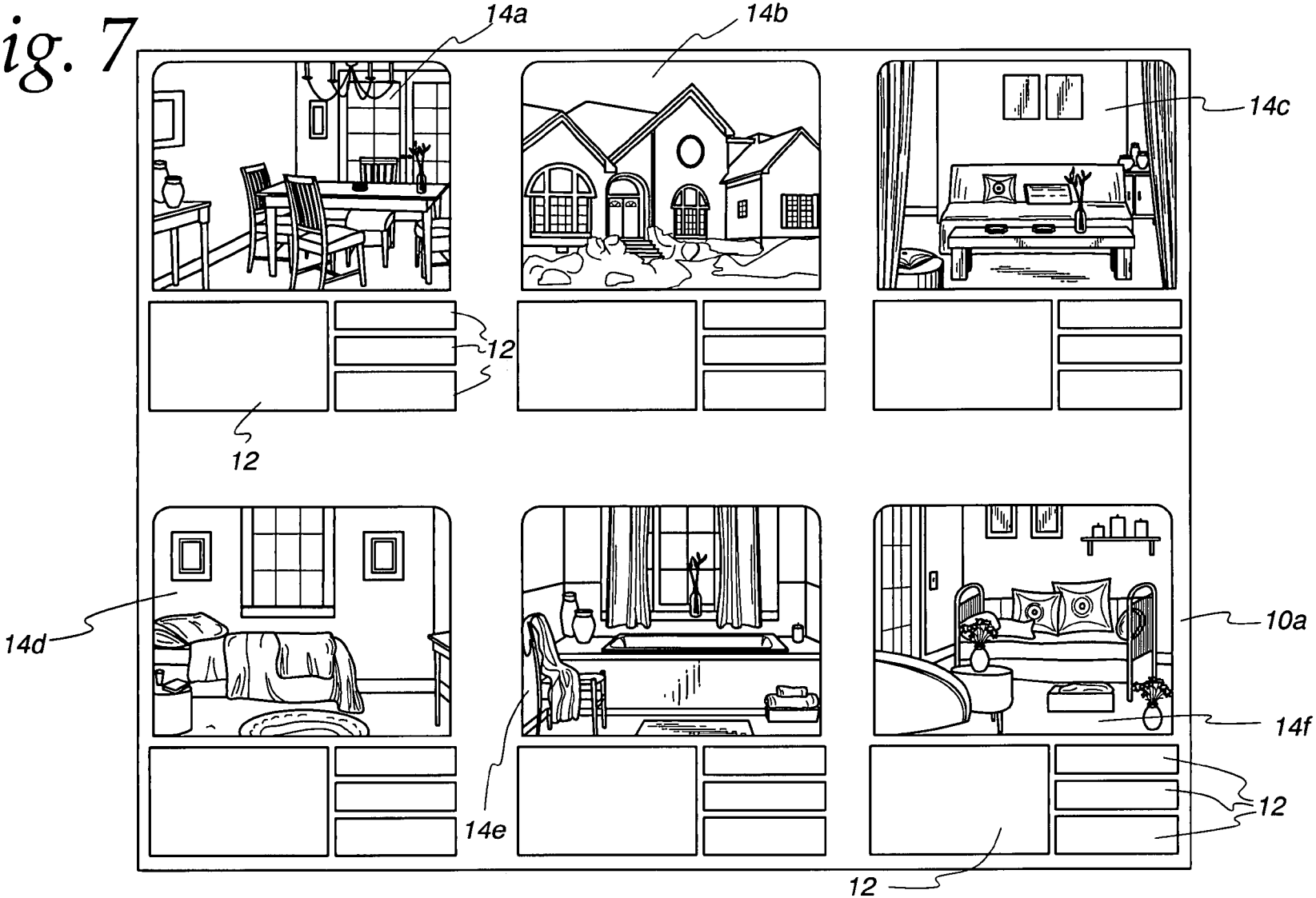
FIG. 7 illustrates a color card having the color chips mounted in place on the card by the mounting machine.
Figure 8:
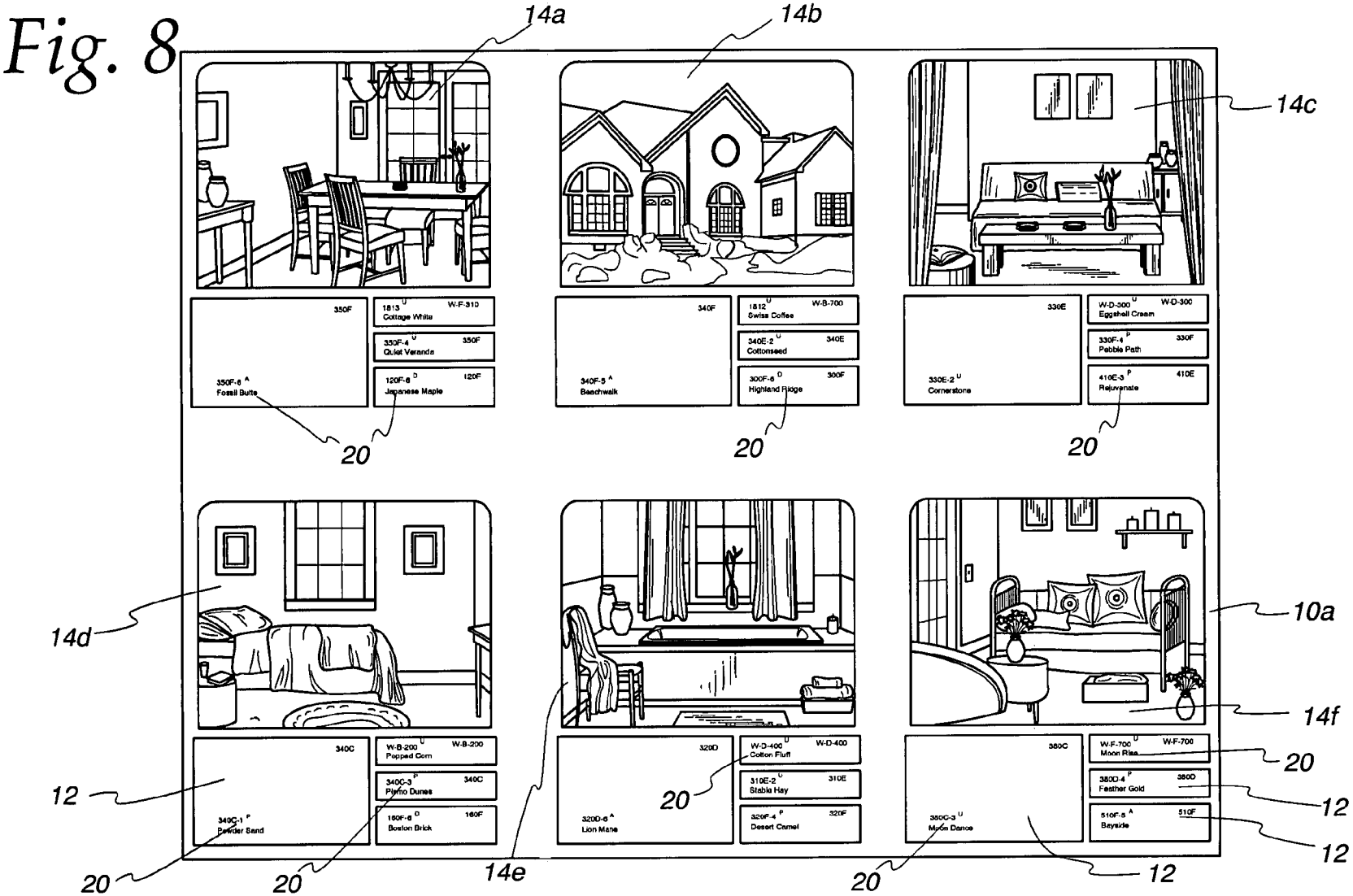
FIG. 8 illustrates a color card after passing through the printing station and having the chips printed with indicia.
Figure 8A:
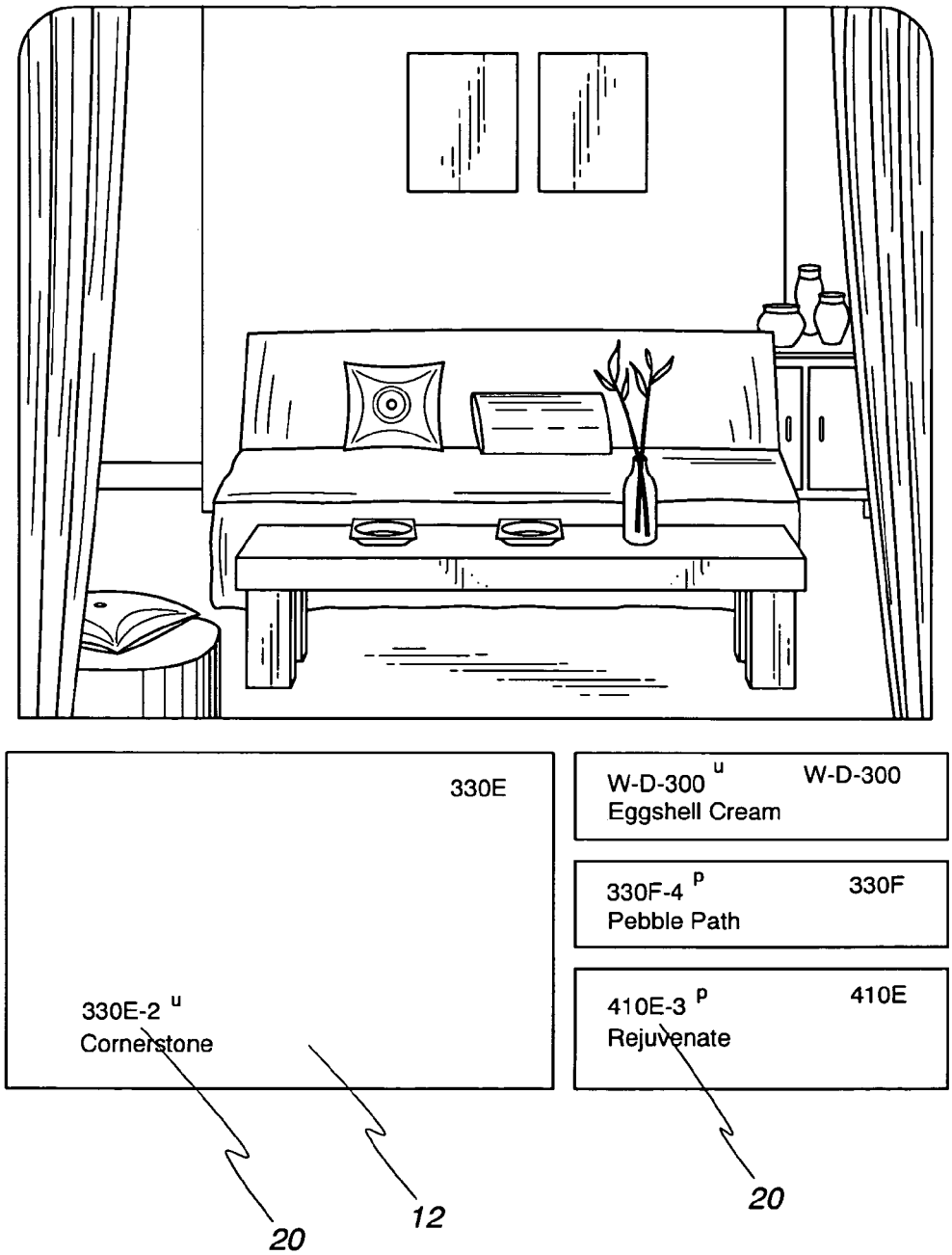
FIG. 8A is an enlarged view of a card having chips printed with indicia.
Figure 9:
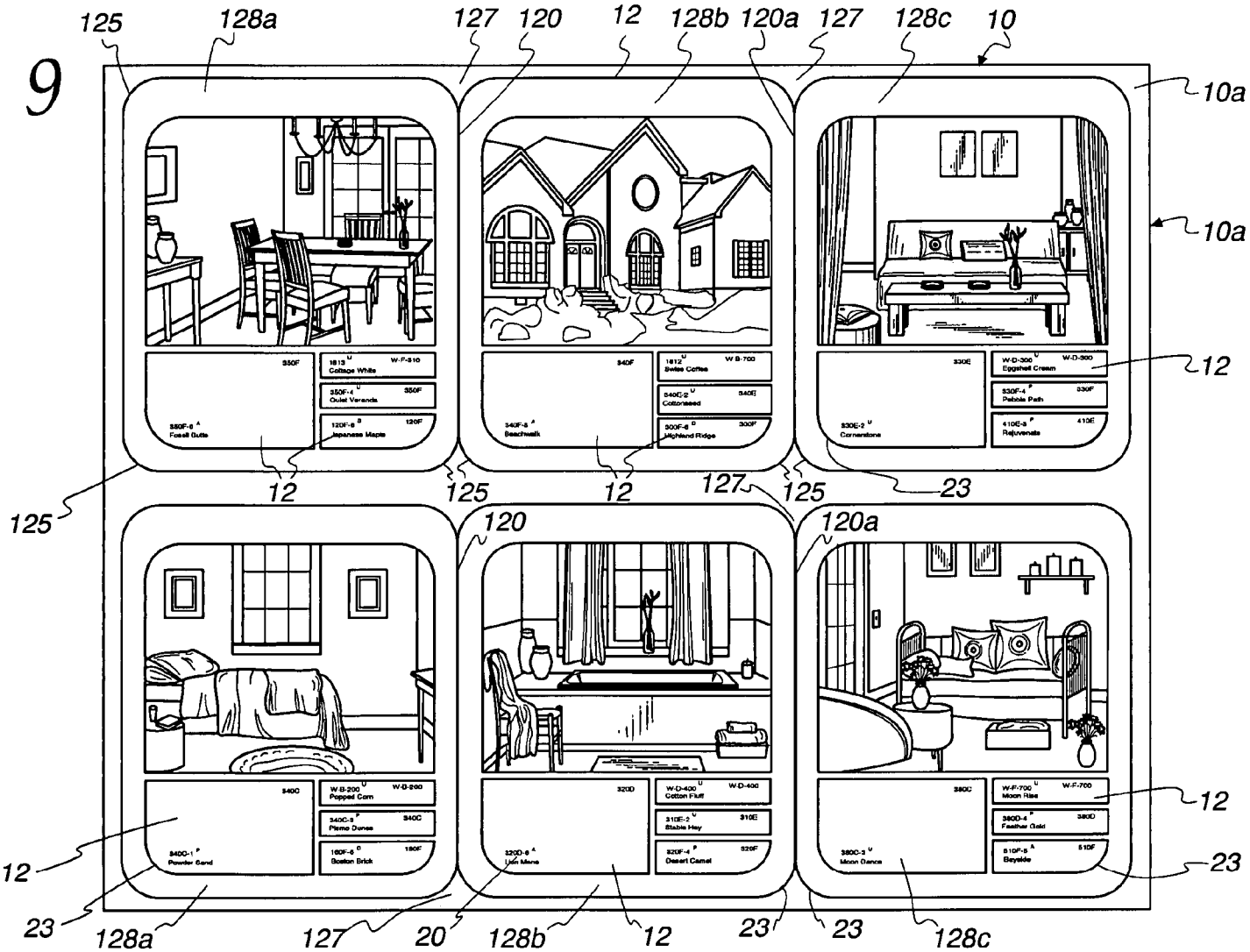
FIG. 9 illustrates a print card having the chips printed and die cut with the paint chip sized and the card sized and ready for folding.

As shown in the drawings for purposes of an illustration, one embodiment is shown herein and this embodiment, which will be described, comprises a method and apparatus for making chip or swatch-bearing sheets 10 such as cards having color chips with printings thereon and further comprises a base sheet or card 10*a* bearing an array of individually colored chips or swatches 12 of various sizes as seen in FIGS. 7–9. The card 10 illustrated in FIGS. 7–9 has photographs 14*a*–14*f*. In the illustrated card 10 shown in FIGS. 7–9 there are six photographs 14*a*–14*f* each of which has rectangular colored chips 12 located beneath a respective picture to show the colors that are used or are available for the photograph of rooms or the exterior of the home depicted in these figures. The card in FIG. 7 has the colored paint chips 12 positioned on the underlying sheet when leaving a mounting machine or station 15 (FIG. 1) of the apparatus. The paint chips are provided with identifying indicia or other forms of indicia 20 (FIGS. 8 and 8A) thereon which is printed on the chips at an in-line machine or printing station 22 of the apparatus and which follows the mounting station as will be described in detail hereinafter. Subsequent to being printed upon the chips and the card are preferably sized such as by having rounded corners 23 on the lower outer edges of the lower two paint chips as best seen in FIG. 9. The chips are cut to size by a die cutting station or trimming station 24 (FIG. 4) which is also in-line with the printing station 22 and receives the cards which pass and travel continuously through the printing station 22 and through the trimming station 24 to a folding machine or station 26, as best seen in FIG. 6 wherein the cards are folded. The folded cards leaving the folding station are shingled and ready to be put into boxes for shipping. Thus, it will be seen that the sheet is usually preprinted with printed matter such as photographs 14 or printed material for identification of the goods which are to be painted with the color. It is preferred to print the color identification indicia directly onto the top surface of the swatch at the printing station. In some instances, the color identifying information is preprinted on the sheet and the swatch is positioned precisely within the box without covering any side of the box and without any subsequent printing on the swatch at the printing station 22.

Figure 1A:
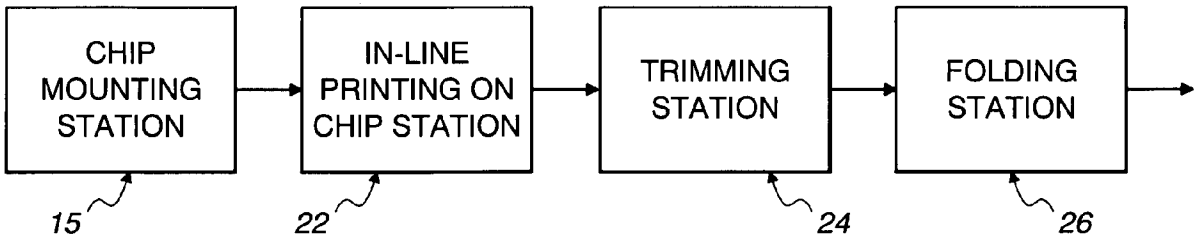
FIG. 1A is a block diagram of the preferred in-line system having an in-line printer for printing on the ink chips.

As explained in each of the aforesaid patents, the chips 12 are adhered to the sheets by spots 28 of glue or adhesive which is applied at an adhesive or gluing station 30 to form the adhesive spots 28 shown in FIG. 1*a* which are located on the sheet beneath the respective photographs 14*a*, 14*b* and 14*c*. Preferably the adhesive spots have shape similar to the final size and shape of the swatch with the spot of adhesives having rounded corners 28*b* as best seen in FIG. 1*a*. For instance, rectangular swatches are applied at the mounting station 15 and they have not been sized or cut yet. At the trimming station 24 these rectangularly shaped swatches will have a scrap portion cut therefrom and this scrap portion is not adhered to the sheet by any adhesive 28 so that it can be readily removed from the sheet while the remaining portion is adhered to the sheet by the glue spots 28. Stated differently the chips are usually oversized relative to the adhesive spots if they are to be cut at the die cutting station 24 and reduced in size with the unadhered scrap being removed by a vacuum.

Thus, it will be seen that in the illustrated embodiment, there is provided a method and apparatus for feeding the sheets 10 through a swatch applying station 15 at which multiple swatches are applied to the sheets; feeding the swatch bearing sheets through an in-line printing station 22 at which indicia is printed on the swatches 12 while traveling through the printing station; feeding the sheets with printed swatches thereon through an in-line trimming station 24 and trimming the swatches to remove portions thereof while traveling through the trimming station; and synchronizing the travel of the swatch bearing sheets discharging from the swatch applying station through the printing station and the trimming station. Preferably, the synchronized speed of travel is obtained by traveling the sheets at a constant velocity by conveyors or feed rollers through the respective machines while print means or heads, trimmer dies, folders, etc. are timed to perform its cyclical operation on each sheet during the time period the sheet and swatch thereon are at that machine. For example, commercially available printers often print a cycle speed of 10,000 sheets per hour and the printing cycle thereof may have to be slowed down to 2,000 sheets per hour to match the cyclical output speed from the swatch applying station. A synchronizing mechanical system or shaft may connect the respective machines at the respective stations or electronic systems may be used to synchronize the feed of sheet travel through each of the respective stations. Preferably, the in-line folding station is aligned to receive the printed and trimmed swatches on the sheets 10 to fold the sheets as they continue to travel at a constant velocity from the trimming station and into the folder at the folding station.

In this in-line system, the swatches are aligned in the longitudinal and in transverse directions on the sheet therefor, the printing means or heads are aligned longitudinally and transversely with the swatches to be printed thereby, the trimming dies are aligned longitudinal and transversely to cut the swatches to trim them, and the folding devices are aligned longitudinally and transversely with respect to fold line positions or areas on the swatch bearing sheets. Moreover, the speed of each in-line operation is synchronized to the constant throughout velocity of the sheets 10 traveling through the in-line system.

Figure 1B:
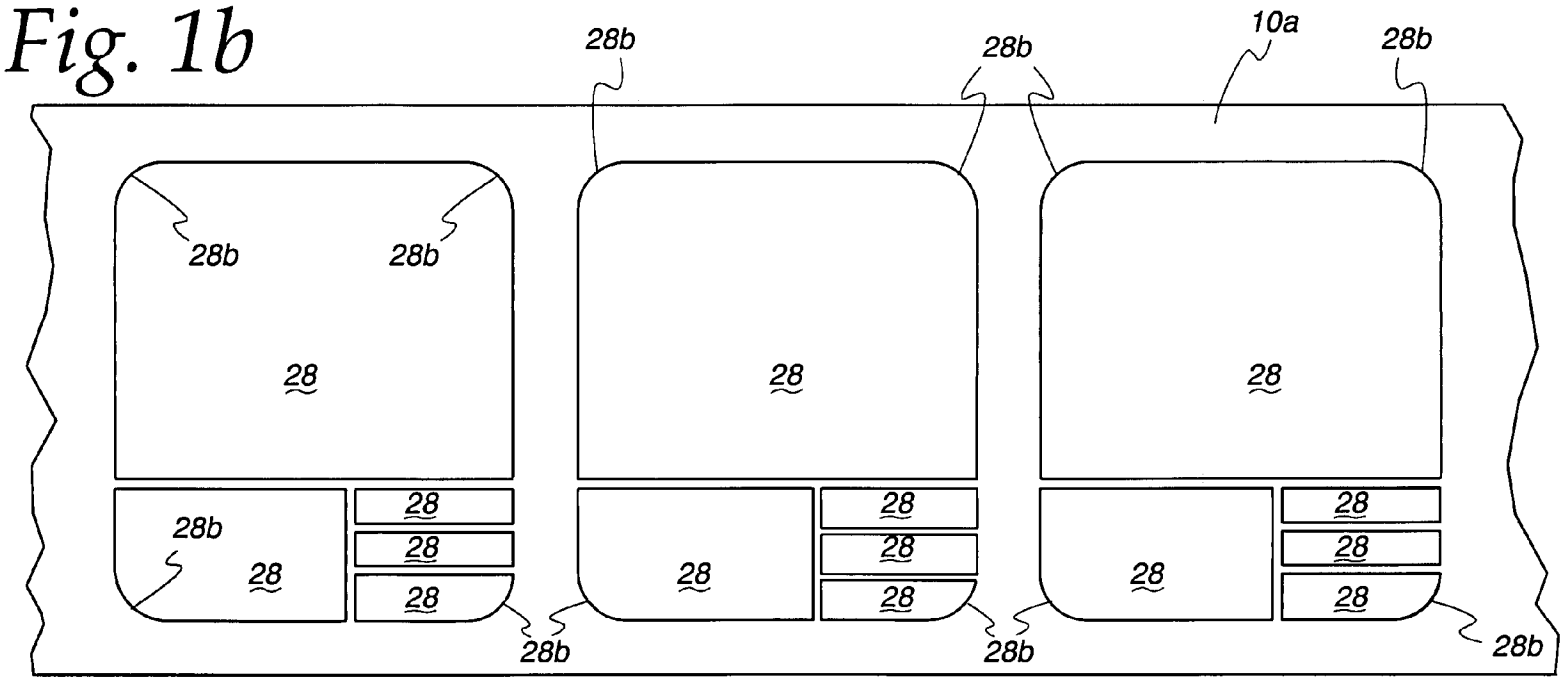
FIG. 1B is a plan view of a card having glue spots thereon to secure the chips to the card.
Figure 2:
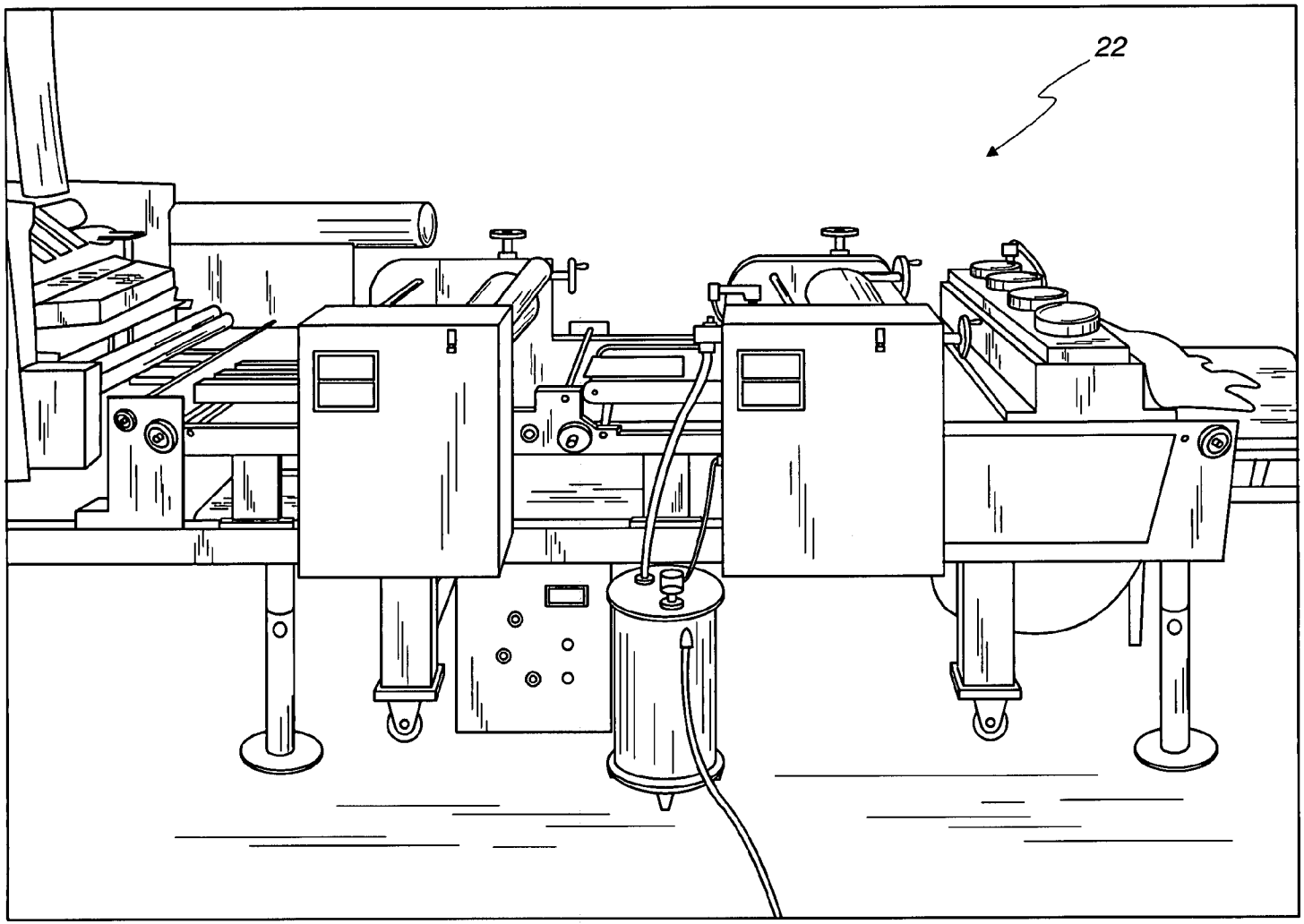
FIG. 2 is a side perspective view of the print station and the end of the chip mounting machine for delivering swatch bearing sheets or webs into the printing station.

Turning now to the illustrated apparatus in greater detail, the swatch mounting machine or station 15 is similar to that described in U.S. Pat. Nos. 4,061,521 and 6,030,481 and hence will only be briefly described herein. In this apparatus a base sheet 10*a* is a stripped from a tray or bin holding a plurality of sheets by a sheet feeding means 34 which delivers the base sheet to a first conveyor 36 which has a plurality of pushers 37 mounted on a chain 38 to push the sheet at the trailing edge thereof to and through the adhesive applying station 30. At the adhesive applying station, rotating adhesive the applying cylinders 39 apply the adhesive spots 28 (FIG. 1B) to each of the swatch receiving locations on the base sheet 10*a*. The base sheets then are fed forwardly from the adhesive applying station in timed relationship by a second conveyor 40 having pushers 41 similar to the pushers 37 to push the trailing edge of the sheet into and through a swatch forming and applying station 42 at which individual colored ribbons are unwound from a ribbon supply 44 having a plurality of colored ribbons each wound in a reel. The reels are fed forwardly to unwind the ribbons which are cut to form the color chips 12 by a severing means 46. The color ribbons are severed by a cutting blade 50 and an anvil blade 52 which pinches off a row of individual swatches from the respective ribbons which are then transferred and pressed by a transfer roller 56 onto the previously applied glue spots 28 on the base sheet 10*a* thereby adhering and affixing the chips to the underlying base sheet 10.

The colored chips 12 thus are adhered to and positioned on the base sheets 10*a* in relationship to the photographs 14 and any other printing and indicia on the sheets at precise positions when leaving the mounting machine or station 15. At the printing station 22, the sheets are delivered and travel at a predetermined speed as determined by the second conveyor 40 which delivers the sheets 10 with the chips 12 thereon to an in-feed conveyor 58 located at the printing machine 22. The in-feed conveyor 58 (FIG. 3) has an endless belt or chain mounted between a rearward sprocket 60 and a forward sprocket 61 for endless travel about a path relative to an in-feed supporting table or surface 63 on which slide the sheets 10. The endless belt 59 has the usual upstanding lugs or pusher fingers 64 which push the sheets forwardly along a straight or horizontal path in a continuous travel mode into and through a nip 65 of a printer 66.

While the particular printer used to print can be varied, the illustrated printer 66 comprises an upper plate cylinder 68 rotatable about a horizontally disposed upper support shaft 73 for the plate cylinder 68. The sheets 10 travel beneath the plate cylinder 68 and across the top of an anvil roller 72 mounted on a horizontally parallel extending support shaft 70.

Unlike the usual printing on flat sheets with no raised portions thereon, the sheets 10 have chips thereon of varying thickness due to the amount of paint thereon. Some paints are made with a thicker coat than other paints and thus form a thicker chip than other chips of a different color. Also there is an underlying adhesive spot 28 for each chip, which is again raising the chip above the upper surface of the base sheet 10*a*. Thus, it will be seen that the printing apparatus should be capable of printing on varying surfaces of chips at different heights.

Another problem in printing sheets 10 using the pusher conveyor 58 which travels at the same speed as the first and second conveyors 36 and 40 of the mounting station 15, is that the pushers 64 do not have a directly mechanical grip for holding the sheet firmly as do the conventional sheet grippers in printing machines that grip the sheet and hold the same while rotating the sheet or moving the sheet forwardly through a nip between a plate cylinder and an anvil roller. It has been found that usually the printing will mar or smear on the raised chips unless there is an improved nip which will hold the sheets firmly while they are traveling through the nip and ink is being applied from the plate cylinder 68 onto the chip passing therethrough.

Figure 10:
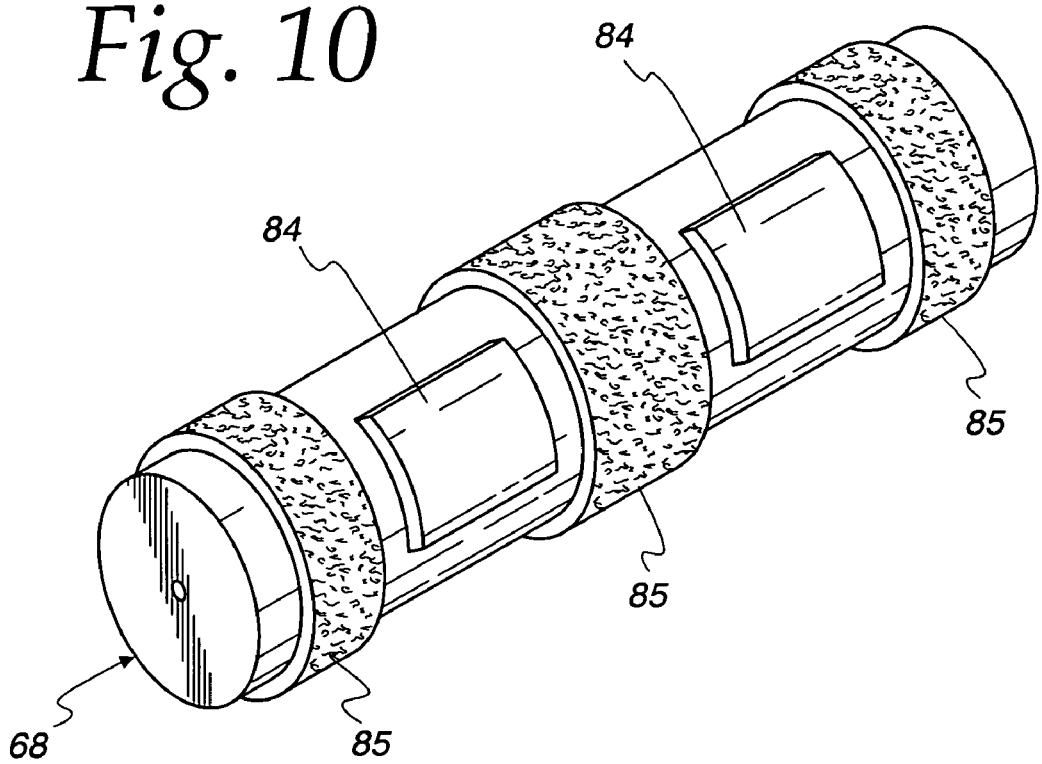
FIG. 10 is a perspective view of a printing cylinder with printing plates and resilient strips to hold the cards against shifting while printing on the chips on the cards.
Figure 11:
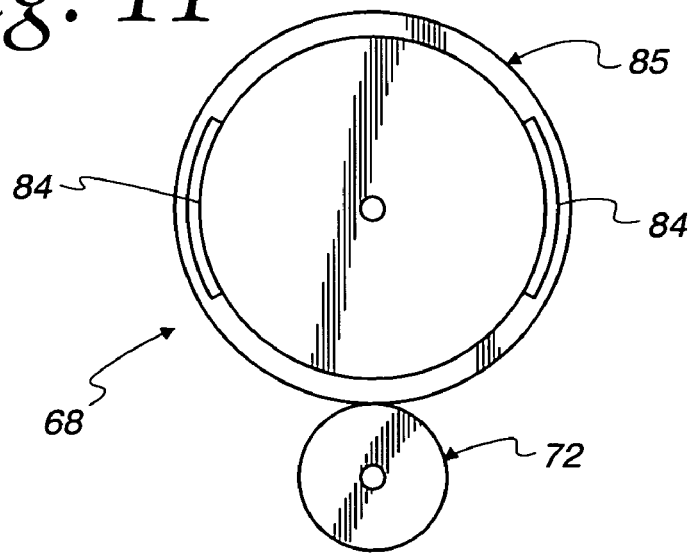
FIG. 11 is a cross-sectional view of the printing cylinder and resilient strips providing a resilient strip for the card and chips thereon.

In order to compensate for the different thickness of the colored chips and height on the sheet 10, it is preferred that the printing plates 84 on the plate cylinder be flexible and made of an elastomeric material or other compressible material. The particular printing plates are spaced actually and circumferentially about the plate cylinder so that each rotation of the plate cylinder there will be a printing applied only to the locations of the chips and not outside of the chips. To hold the sheet 10 firmly against shifting so that it will not move relative to the printing plates 84 on the plate cylinder, it is preferred to provide resilient strips 85 as best seen in FIGS. 10 and 11 on the surface of the plate cylinder to have a height width matching or above the outer peripheral surface of the plate cylinder such that the base sheet 10*a* is gripped by the resilient strips 85 and forms a sheet gripping nip with the underlying anvil roller 72 to hold the sheet against shifting or otherwise moving during the printing operation by the flexible printing plate on the overhead rotating plate cylinder 68. The preferred strips 85 are made of an elastomeric material and are attached to the surface of the plate cylinder by an adhesive or fasteners.

Figure 3:
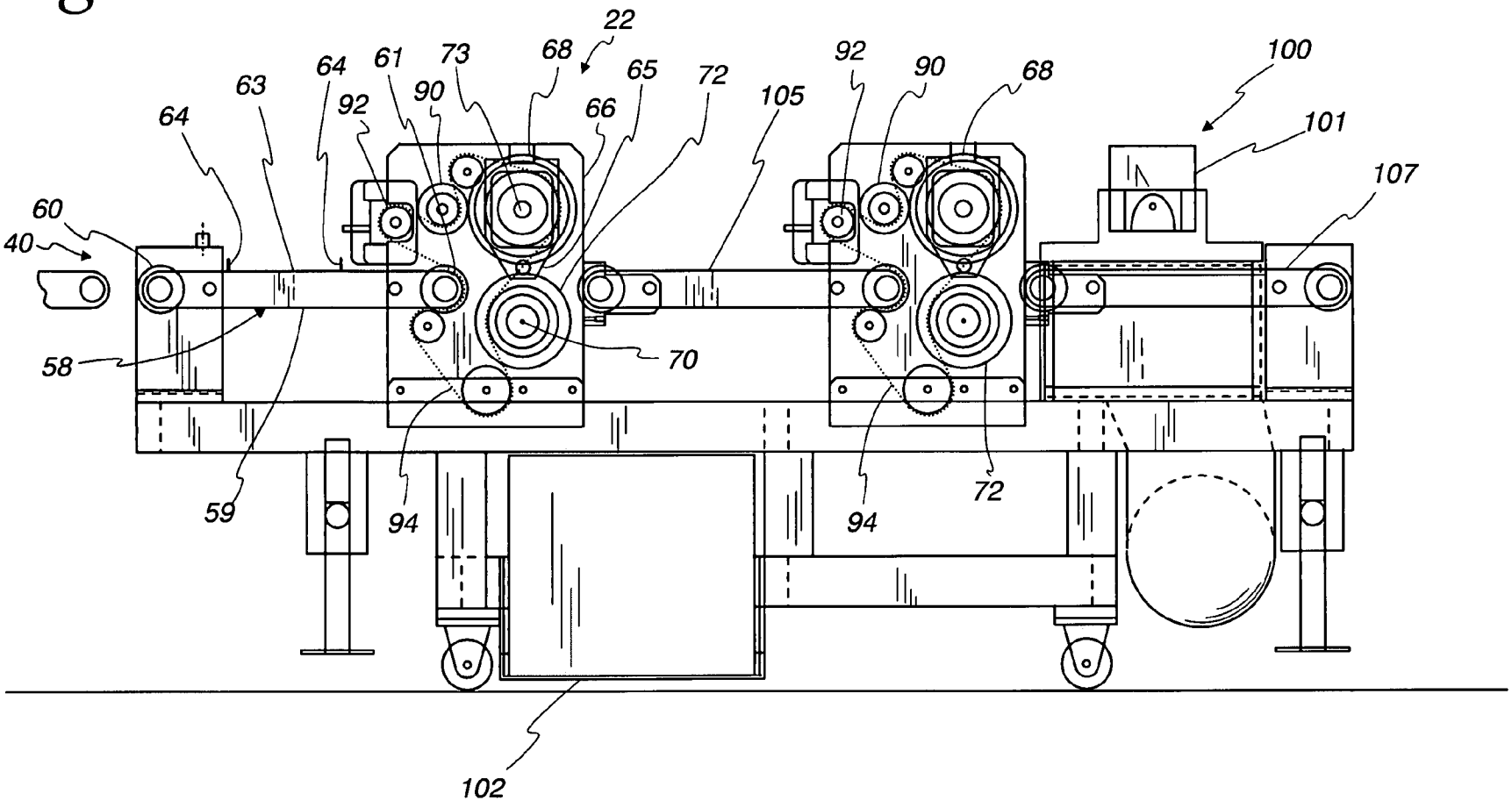
FIG. 3 is a side-elevational view showing the printing cylinders, conveyors and UV systems at the printing station for the illustrated embodiment of the invention.

The particular system shown in FIG. 3 includes an analox system comprising an analox roller 90 which has space circumferential openings thereon to receive ink from a ink metering roller 92 rotatable about a horizontal axis. The ink is fed in a conventional manner from an ink reservoir by the ink metering roll to the analox roller which applies the ink to the flexible printing plates 84 on the rotating plate cylinder 68. The plate cylinder, anvil roller, analox roller, and ink meeting roller are driven by a common timing chain 94 which is also meshed with and driven by conveyor sprocket 61 for the in-feed conveyor 38 so that the timing of the plate cylinder and anvil roller to the movement of the sheets being pushed by the pushers is being synchronized to cause the printing operation to print on top of the respective colored chips at the precise location desired.

In accordance with another aspect of the illustrated embodiment, the ink being used is a UV curable ink which passes by a radiant UV source 100 which exerts energy in the UV range to quickly drive the ink. To this end, the UV source comprises a UV lamp assembly 101 having enclosed lamps positioned closely adjacent the UV ink on the chips at the discharge end of the printing station 22. A UV power supply 102 is located beneath and between first and second printing assemblies and beneath an in-feed pusher conveyor 105 for the second printing assembly that is identical to the first printing assembly and hence will not be described again. The pusher in-feed conveyor is similar to the in-feed conveyor 58 and hence it will not be described again in detail. A conveyor 107 conveys the printed chips 12 through the UV station to assure that the ink is dry as it leaves the printing station and is delivered to the trimming station. Beneath the UV lamp assembly is disposed a exhaust duct 100 as best seen in FIG. 3 for conveying away any fumes from the UV ink as it is being cured.

The chips 12 are applied to adhesive spots 28 (FIG. 1B) and then are later cut to their final size and shape at the trimming station 24 by a flexible die 110 mounted on a rotating die cutter cylinder 112 mounted in the die cutting machine 114. One problem with this approach is the removal of the scrap which is cut from the chips 12 and/or photographs, herein illustrated as being rounded corners 28*b*. The scrap is preferably kept adhered to the rotating cylinder 112 by a negative, vacuum pressure from inside the cylinder until the cylinder rotates away from the die cut nip and into a scrap removal station at which is the inlet of a vacuum scrap pipe located with an inlet end closely adjacent the surface of the die cut cylinder. Preferably, the internal vacuum pressure in the die cutting cylinder is then switched by a valve to a positive air force to push the scrap away and into the vacuum pipe for transport by air to a remote collection point away from the rotating cylinder 112 and preferably away from the die cutting machine 114.

To increase the production rate of the system, the system produces a double wide stream of two cards and it is the die cutting station that cards are separated from one another. As best seen in FIG. 9, there is an upper card and a lower card. Each card has three sections and are joined to an adjacent section at a line 120 and 120*a* which will become fold lines when the card is folded subsequently in the in-line folding station 26. In addition to cutting the rounded corners 23 on the chips, as shown in FIG. 9, the card itself is cut with rounded corners 125 at all four corners of each section. At the location of the potential fold lines 120 and 120*a*, the cut material defines a V-shaped space 127 between sections; as shown in FIG. 9. Manifestly, the cards can be formed without the rounded corners or have other shapes with a change of the flexible cutting dies on the die cutting cylinder. Also, other die cutting machines using flat beds or systems can be used; the continuous in-line feeding used in this embodiment to use a continuously traveling conveyor 129 is preferred for higher production speeds.

After having cut and shaped to size, the respective rows of cards leaving the trimming station 24 are carried in two side-by-side streams on an in-feed conveyor into an automatic folding machine 135 at the folding station 26. At the folding station, one end section such as the section 128*a* is folded back over the top of the center section 128*b* and the other end section 128*c* such as the trailing end section 128*c* is folded over the top of the leading end section 128*a* to provide a three ply folded color card which is seen (FIG. 6) leaving in two streams of cards from the folding station 26. The holder card is now ready to be boxed and shipped.

What is claimed is:

1. A method of manufacture of chip bearing sheets having chips with printing thereon, the method comprising:

forming sheets with colored chips adhered to the sheets at spaced locations on the sheet at a chip mounting station;

feeding the sheets forwardly from the chip mounting station to a printing station; and while the sheets are continuously moving through the printing station performing a printing operation to print indicia on the outer surface of the colored chips.

2. A method in accordance with claim 1 comprising:

providing oversized colored chips on the sheets; and trimming the chips on the sheets at a trimming station to trim the chips to size.

3. A method in accordance with claim 2 comprising:

trimming the chips with die cutters on the sheets at the trimming station as the sheets are continually traveling through the trimming station.

4. A method in accordance with claim 2 comprising:

printing on the colored chips prior to trimming the chips at the trimming station.

5. A method in accordance with claim 2 comprising:

printing within a bounded area on the color chip and then trimming the chip to remove cut trim outside of the boundary area having the printing.

6. A method in accordance with claim 2 comprising extracting the cut scrap trim by a vacuum at the trimming station from the printed chip.

7. A method in accordance with claim 2 comprising:

die cutting the chip to size with a rotating die cutting cylinder;

holding the cut trimmed waste onto the die cutting cylinder with a first vacuum; and releasing and the vacuum and applying another vacuum to extract the trimmed scrap at a extracting station.

8. A method in accordance with claim 1 comprising:

folding the sheets having the printed colored chips thereon at a folding station.

9. A method in accordance with claim 1 comprising:

trimming the chips on the sheets at a trimming station to trim the chips to size; and folding the sheet having the printed colored chips thereon.

10. A method in accordance with claim 1 comprising:

feeding a succession of sheets along a predetermined straight path of travel; and severing individual chips from ribbons to form the chips, and adhering the severed chips to the sheets to form the sheets with the colored chips at the chip applying station.

11. A method in accordance with claim 1 comprising;

feeding a web having sheets to be formed therefrom along a predetermined path of travel; and adhering chips to the web at predetermined locations along the web as it travels through the chip mounting station and severing the web into sheets prior to printing the colored chips with indicia.

12. A method of manufacture of chip bearing sheets having chips adhered to the sheet and having printing on the chips, the method comprising:

forming the sheets with colored chips adhered thereto to the sheets at spaced locations along the sheet at a chip mounting station at a speed in excess of 2,000 sheets per hour;

continuously moving the sheets forwardly from the chip mounting station to a printing station and printing on the sheets while they are continuously traveling through the printing station with indicia on the outer surface of the colored chips at a speed matched to the speed of travel of the chips through the chip mounting station.

13. A method in accordance with claim 12 comprising:

a mechanical in-line connection between the chip mounting station and the printing station to synchronize the speed of sheets while traveling at speeds to provide a rate of about 2,000 sheets per hour or more.

14. A method in accordance with claim 12 comprising:

synchronizing the speed of operation of a die cutting machine at a die cutting station with the speeds of the printing machine and the chip mounting machine and trimming the colored chips thereon at a rate of about 2,000 sheets per hour or more.

15. A method in accordance with claim 14 comprising:

a folding machine for folding the sheets having the trimmed and printed colored chips thereon;

the folding machine being in line and being synchronized with the chip mounting machine; and the die cutting machine and the printing machine folding the sheets as they continuously travel forwardly at a rate of about 2,000 sheets per hour or more.

16. An apparatus for manufacture of chip bearing sheets having chips for printing thereon;

the apparatus comprising a chip mounting machine for adhering colored chips to sheets at spaced locations on the sheet;

a feeder for feeding the sheets forwardly from the chip mounting machine to a printing station; and a printer in-line with the chip mounting machine for printing indicia on the outer surface of a colored chips while the chips and sheets are continuously moving through the printing station.

17. An apparatus in accordance with claim 16 comprising:

a trimming device for trimming oversized colored chips on the sheets to a predetermined size or shape.

18. An apparatus in accordance with claim 17 wherein the trimming device comprises a rotary die cutting head which die cuts the colored chips to size or shape.

19. An apparatus in accordance with claim 16 comprising:

a trimmer located downstream of the printer to cut the printed chips to trim them to size; and a folding machine located downstream of the printer to fold continuously traveling sheets having the chips with printed indicia and chips trimmed to size.

20. An apparatus in accordance with claim 16 comprising;

a rotating die cutting head for trimming the chips to size; and the die cutting head have a vacuum removal system associated therewith to remove the trimmed chip material from the die cutter head.

21. An apparatus in accordance with claim 16 comprising:

pushers for pushing the sheets through the chip mounting machines and for pushing the sheets through the printing stations; and a rotating plate cylinder and an anvil roller defining a nip through which the sheets are pushed by the pushers.

22. An apparatus in accordance with claim 21 comprising:

a rotating plate cylinder at the printing station having raised printing surfaces on the surface of the plate cylinder; and resilient strips mounted on the plate cylinder and spaced axially and adjacent the raised printing areas on the plate cylinder to provide a nip with the anvil roller to hold the sheet adjacent the raised printing areas to prevent smearing of the ink being printed on the chips.

23. An apparatus in accordance with claim 22 wherein:

the resilient strips are elastomeric strips which form a nip with the opposing anvil roller.

24. An apparatus in accordance with claim 22 wherein:

the different chips have a different color with a different thickness of paint forming the chip.

25. An apparatus in accordance with claim 22 wherein:

the printing device prints with a UV curable ink; and a UV curing system applies UV energy to cure the ink following the printing thereof.

26. An apparatus in accordance with claim 25 wherein:

there are multiple UV printing stations; and the UV curing system following the printing stations to cure the ink having been printed on the chips.

27. A method of in-line handling of swatches and sheets therefor comprising:

feeding the sheets to travel through a swatch applying station at which multiple swatches are applied to the traveling sheet;

feeding the swatch bearing sheets through an in-line printing station having a printing means for printing on the swatches aligned therewith while the swatches are traveling through the printing station;

feeding the sheets with swatches having printed indicia thereon through an in-line trimming station and trimming the swatches to remove portions thereof while traveling therethrough; and synchronizing the speed of travel of the swatches bearing sheets during travel of the swatches on the sheets from the swatch applying station through the printing station and through the swatch trimming station.

28. A method in accordance with claim 27 comprising;

feeding the sheets having the printed and trimmed swatches thereon through an in-line folding station and folding the sheets as they are fed from the trimming station.

29. A method in accordance with claim 28 aligning the swatch applying station, the swatch printing station, the trimming station and the folding station in a longitudinal straight line for a straight line feeding of the sheets through these respective stations.

30. A method in accordance with claim 29 comprising:

synchronizing respective stations speed of operations to allow the sheets to travel at a substantial constant velocity through the respective stations.

31. A method in accordance with claim 27 comprising:

an air stream for automatically removing scrap trimmed from the swatches.

* * * * *